United States Patent [19]

Kido et al.

[11] Patent Number: 5,034,095

[45] Date of Patent: Jul. 23, 1991

[54] APPARATUS AND PROCESS FOR THE DELIGNIFICATION OF CELLULOSE PULP

[75] Inventors: Junichiro Kido, Kasugai; Hajime Yamanaka, Nagoya; Masaru Hirasawa, Yokohama; Keiichi Tsuchiya, Kawasaki, all of Japan

[73] Assignee: Oji Paper Co., Ltd., Tokyo, Japan

[21] Appl. No.: 466,113

[22] Filed: Jan. 16, 1990

[30] Foreign Application Priority Data

Jun. 1, 1989 [JP] Japan ..... 1-137403

[51] Int. Cl.[5] ..... D21C 3/02; D21D 7/00

[52] U.S. Cl. ..... 162/17; 162/65; 162/90; 162/233; 162/237; 162/246

[58] Field of Search ..... 162/17, 52, 65, 233, 162/237, 246, 90; 422/220, 310; 138/109, 177, 178; 137/219

[56] References Cited

U.S. PATENT DOCUMENTS 3,353,561 11/1967 Monteleone ..... 138/37
3,398,576 8/1968 Cleary ..... 138/37
3,881,985 5/1975 Simmons et al. ..... 162/17
4,101,280 7/1978 Frietzsche et al. ..... 55/DIG. 30
4,548,625 10/1985 Ishida et al. ..... 55/DIG. 30

*Primary Examiner*—Richard V. Fisher
*Assistant Examiner*—Charles K. Friedman
*Attorney, Agent, or Firm*—Armstrong, Nikaido, Marmelstein, Kubovcik & Murray

[57] ABSTRACT

A cellulose pulp slurry is delignified in an apparatus comprising a vertical cylindrical barrel chamber, a cone-shaped bottom chamber connected to the barrel chamber and having a circular inlet formed in a lower end portion thereof, and a cone-shaped top chamber connected to the barrel chamber and having a circular outlet formed in a top end portion thereof, in which apparatus the cone-shaped top and bottom chambers converge at a convergence angle of 60 degrees or less respectively, by feeding a cellulose pulp slurry containing an alkali and oxygen and having a pulp consistency of 8 to 15% into the apparatus through the circular inlet of the bottom chamber at 70° C. to 140° C., and discharging the pulp slurry through the circular outlet of the top chamber, while controlling the flow speed of the pulp slurry in the barrel chamber to a level of 0.4 m/min or more.

4 Claims, 5 Drawing Sheets

○ COMPARATIVE TREATMENT COLUMN 21
● TREATMENT COLUMN 14 OF THE PRESENT INVENTION
CHANNELLING RATIO (%)
10
5
0
0.400
0.500
1.000
FLOW SPEED (M/MIN) OF PULP SLURRY THROUGH BARREL CHAMBER

APPARATUS AND PROCESS FOR THE DELIGNIFICATION OF CELLULOSE PULP

BACKGROUND OF THE INVENTION

1. Field of the Invention

The present invention relates to an apparatus and process for the delignification of cellulose pulp.

More particularly, the present invention relates to an apparatus and process for delignifying a cellulose pulp slurry at a medium pulp consistency with an alkali and oxygen.

2. Description of the Related Arts

For removing a lignin substance from a cellulose pulp by using an alkali and oxygen, a practical process in which an alkali, oxygen and heating steam are mixed into a cellulose pulp slurry having a pulp consistency adjusted to a medium level of 8 to 15% by weight (based on the dry weight of the pulp), the temperature of the mixed slurry is controlled to 70° to 140° C., the heated mixed slurry is fed under pressure to a delignification apparatus (column), and a desired delignification treatment is applied to the cellulose pulp while the slurry rises from a bottom inlet to a top outlet of the delignification apparatus, is carried out. In this practice, at least two treatment apparatuses (columns) of the above-mentioned type are connected in series and the delignification treatment is applied at least twice to the cellulose pulp slurry.

In the above-mentioned conventional delignification apparatus and process, the rising flow of the mixed pulse slurry fed into the delignification apparatus is likely to differ at the central portion of the treatment apparatus and at portions close to the wall surface of the apparatus. Namely, a high-speed flow, called "channelling", is readily generated in the central portion of the treatment apparatus, and therefore, the portion of mixed pulp slurry flowing through the central portion of the treatment apparatus cannot reside in the treatment apparatus for a desired reaction time and is discharged under an insufficiently reacted condition from the treatment apparatus, while the portions of the mixed pulp slurry flowing close to the wall surface reside in the treatment apparatus for longer than the desired residence time. These uneven flow and residence times of the pulp slurry result in an uneven quality of the resultant delignified cellulose pulp.

To prevent this uneven flow of the mixed pulp slurry, it is widely attempted to arrange a distributor for feeding a mixed pulp slurry and regulating the flow of the fed slurry in the vicinity of the mixed pulp slurry feed inlet of the treatment apparatus, and locating a discharger for discharging (scraping out) the mixed pulp slurry in the vicinity of the mixed pulp slurry discharge outlet.

The arrangement and use of the above-mentioned distributor and discharger, however, result in increased equipment costs and the costs for operating these devices. Moreover, the pressure loss of the mixed pulp slurry in the apparatus becomes large, and thus the maintenance cost of the apparatus is increased.

SUMMARY OF THE INVENTION

An object of the present invention is to provide an apparatus and process for the delignification of cellulose pulp by uniformly flowing a cellulose pulp slurry through the apparatus while applying a uniform delignification treatment to the cellulose pulp slurry, without arranging and using a conventional distributor and discharger.

The above-mentioned object can be attained by the apparatus and process of the present invention for the delignification of cellulose pulp.

The apparatus of the present invention comprises a cylindrical barrel chamber extending in the vertical direction; a substantially cone-shaped bottom chamber connected to the lower end of the barrel chamber, extending and converging downward and provided with a circular inlet means for feeding a cellulose pulp slurry to be delignified therethrough, formed in a lower end portion of the bottom chamber; and a substantially cone-shaped top chamber connected to the top end of the barrel chamber extending and converging upward and provided with a circular outlet means for discharging the delignified cellulose pulp therethrough, formed in a top end portion of the top chamber.

The cone-shaped bottom chamber and the cone-shaped top chamber converging at an angle of convergence of 60 degrees or less respectively through circumferences of the circular inlet and the circular outlet.

The process of the present invention using the above-mentioned apparatus, comprises the steps of:

feeding a cellulose pulp slurry containing an alkali and oxygen and having a pulp consistency of 8 to 15% at a temperature of 70° C. to 140° C. into the cone-shaped bottom chamber through the circular inlet; and discharging the delignified cellulose pulp slurry from the cone-shaped top chamber through the circular outlet, while controlling the flow speed of the cellulose pulp slurry in the cylindrical barrel chamber to a level of 0.4 m/min or more.

DESCRIPTION OF THE PREFERRED EMBODIMENTS

The structure of the apparatus of the present invention for the delignification of cellulose pulp will now be explained with reference to FIG. 1 and 2.

Figure 1:
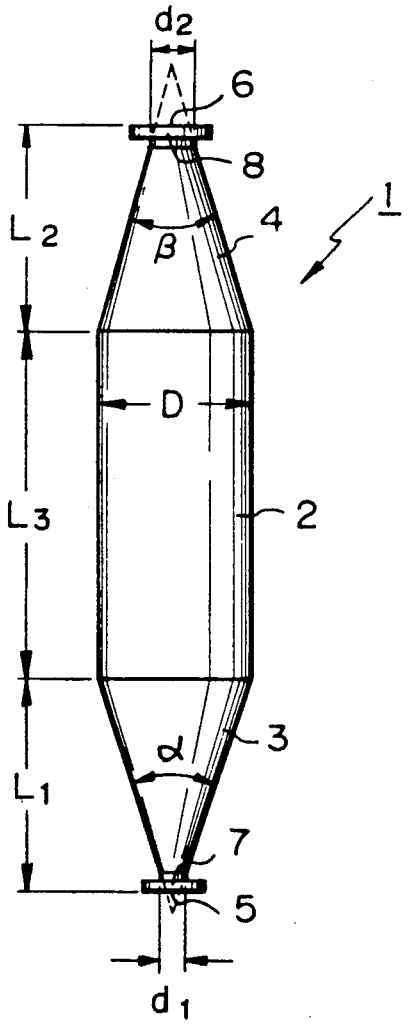
FIGS. 1 and 2 are, respectively, front views illustrating one embodiment of the apparatus of the present invention for the delignification of a cellulose pulp.

Referring to FIG. 1, a delignification apparatus (column) 1 comprises a cylindrical barrel chamber 2 extending in the vertical direction, a substantially cone-shaped bottom chamber 3 connected to the lower end of the barrel chamber 2 and extending and converging downward, and a substantially cone-shaped top chamber 4 connected to the upper end of the barrel chamber 2 and extending and converging upward.

The cone-shaped bottom chamber 3 has a circular feed inlet 5 opened at the lower end portion thereof and is in the shape of a truncated cone.

Also the cone-shaped top chamber 4 has a circular discharge outlet 6 opened at the upper end portion thereof and is in a shape of a truncated cone.

Each of the convergence angle $\alpha$ of the cone-shaped bottom chamber 3 through the circumference 7 of the circular feed inlet 5 thereof and the convergence angle $\beta$ of the cone-shaped top chamber 4 through the circumference 8 of the circular discharge outlet 6 thereof is 60 degrees or less, preferably 20 to 60 degrees.

If at least one of the convergence angles $\alpha$ and $\beta$ exceeds 60 degrees, the flow of the cellulose pulp slurry in the treatment apparatus becomes uneven, and thus the quality of the resultant delignified pulp becomes non-uniform. To avoid an excessive length of the reaction apparatus, preferably neither of the convergence angles $\alpha$ and $\beta$ are smaller than 20 degrees.

The convergence angles $\alpha$ and $\beta$ can be calculated according to the following formulae:

$$\alpha = 2\tan^{-1}\left[\frac{D - d_1}{2L_1}\right] \leqq 60 \text{ degrees}$$

and $$\beta = 2\tan^{-1}\left[\frac{D - d_2}{2L_2}\right] \leqq 60 \text{ degrees}$$

wherein D represents the inner diameter of the barrel chamber, $d_1$ represents the inner diameter of the feed opening of the bottom chamber, $d_2$ represents the inner diameter of the discharge opening of the top chamber, $L_1$ represents the length of the bottom chamber, and $L_2$ represents the length of the top chamber.

Also, in FIG. 1, $L_3$ represents the length of the barrel chamber 2.

Figure 2:
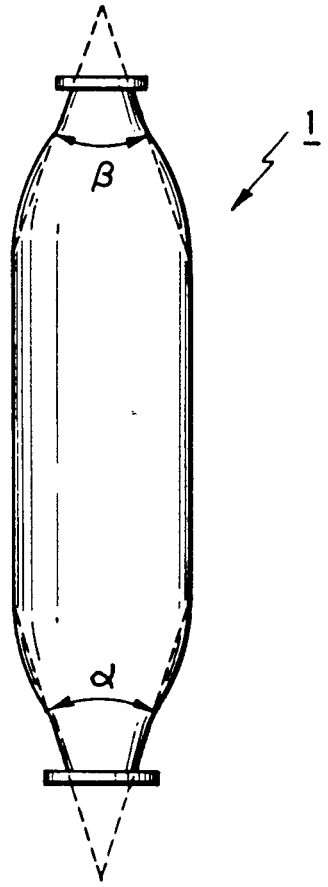

The inner wall faces of the bottom and top chambers of the treatment apparatus of the present invention can bulge slightly outward or inward over the conical face, indicated by the dotted line in FIG. 2, as long as the intended object of the present invention can be attained. Nevertheless, the convergence angles $\alpha$ and $\beta$ must be 60 degrees or less.

Since the treatment apparatus of the present invention has cone-shaped bottom and top chambers, each having a specific convergence angle, the cellulose pulp-containing slurry fed into the treatment apparatus flows and rises uniformly through the treatment apparatus, i.e. there is no or very little flow unevenness, and accordingly, the cellulose pulp slurry is uniformly treated in the treatment apparatus. Due to these characteristic features, there is no need to arrange a mechanical feeding and flow regulating device in the bottom chamber of the treatment apparatus of the present invention, or a mechanical discharge device in the top chamber of the treatment apparatus of the present invention. Accordingly, the treatment apparatus of the present invention is advantageous in that the equipment cost and operation cost are low and the maintenance costs can be reduced.

In the process of the present invention for delignifying cellulose pulp by using the above-mentioned apparatus, an aqueous slurry containing a cellulose pulp at a medium pulp consistency of 8 to 15% is premixed with predetermined amounts of an alkali, oxygen and heating steam, the mixture is heated at a temperature of 70° to 140° C., and the thus prepared pulp slurry is fed into the treatment apparatus through the feed inlet in the bottom chamber and discharged through the discharge outlet in the top chamber. In this treatment, the flow speed of the cellulose pulp slurry in the barrel chamber of the treatment apparatus is controlled to a level of 0.4 m/min or more, preferably 0.6 m/min or more, especially preferably 0.7 m/min or more.

The flow speed of the cellulose pulp slurry in the barrel chamber can be calculated according to the following equation:

$$W = \frac{P \times (1 - x)}{1440 \times 0.01 \times C} \times \frac{4}{\pi D^2} > 0.4$$

wherein W represents the flow speed (m/min) of the cellulose pulse slurry through the barrel chamber, P represents the air-dried weight ton (1000 kg/day) of the pulp fed per day to the treatment apparatus, x represents the water content of the air-dried pulp, C represents the consistency (%) of the pulp in the cellulose pulp slurry, and D represents the inner diameter (m) of the barrel chamber.

Where x=0.1, the feed rate W is represented as follows:

$$W = \frac{P \times 0.9}{1440 \times 0.01 \times C} \times \frac{4}{\pi D^2} = 0.25\frac{P}{c\pi D^2} \text{ (m/min)} > 0.4$$

If the flow speed of the cellulose pulp slurry through the barrel chamber of the treatment apparatus is less than 0.4 m/min, the uniformity of the rising flow of the cellulose pulp slurry in the treatment apparatus is poor, and thus the quality of the resultant delignified pulp is uneven.

In the process of the present invention, the operation of mechanically feeding the cellulose pulp slurry and regulating the flow of the slurry at the bottom chamber of the treatment apparatus is unnecessary, and the operation of mechanically discharging the cellulose pulp slurry at the top chamber of the treatment apparatus is also unnecessary.

The process of the present invention will be described in detail with reference to FIG. 3.

Figure 3:
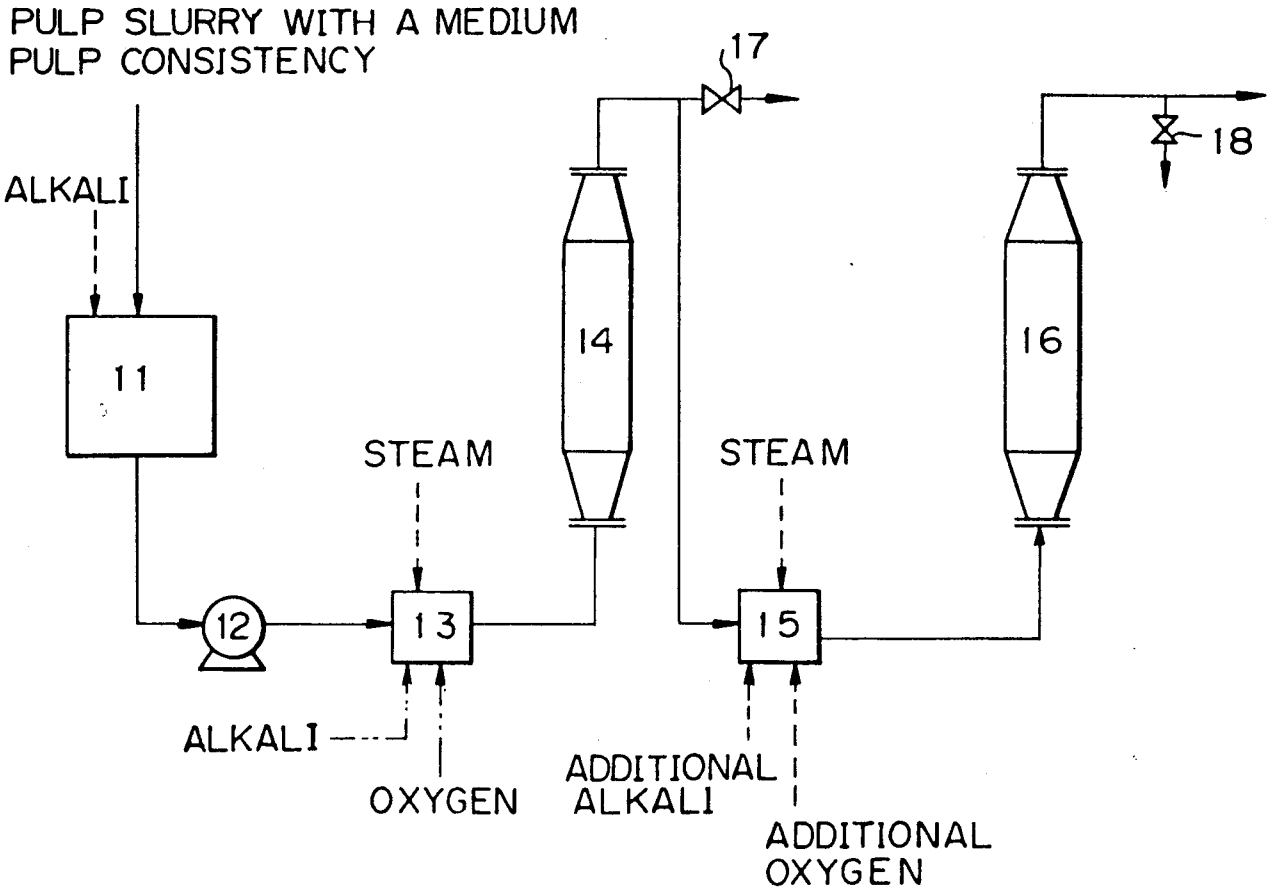
FIG. 3 is a diagram illustrating an example of the treatment apparatus system including the apparatus of the present invention.

Referring to FIG. 3, an aqueous slurry containing a cellulose pulp at a predetermined pulp consistency (8 to 15%) is fed into a store tank 11, and a predetermined amount (for example, 1.0 to 3.5 kg/kappa number reduction of 1.ton of absolutely dried pulp) of an alkali, for example, caustic soda, is mixed into the aqueous slurry.

The alkali-containing pulp slurry is fed into a mixer 13 from the store tank 11 through a pump 12, and a predetermined amount (for example, 0.7 to 3.0 kg of oxygen/kappa number reduction of 1.ton of absolutely dried pulp) of an oxygen-containing gas (for example, pure oxygen gas or air) is mixed into the slurry in the mixer 13 and heating steam is blown into the slurry. The slurry is heated at a predetermined temperature (for example, 70° to 140° C.).

The thus prepared pulp slurry is fed under a predetermined pressure (for example, 0 to 15 kg/cm$^2$G) into a first treatment column 14 through a feed opening at the bottom thereof and made to flow and rise through the treatment apparatus. Preferably, at this step, the pressure of the top chamber of the first treatment column 14 is 0 to 7 kg/cm$^2$G. Also preferably, the residence time of the pulp slurry in the first treatment apparatus 14 is 5 to 90 minutes. The pulp slurry discharged through the discharge opening of the top chamber of the first treatment column 14 is conveyed to a mixer 15 and, if necessary, predetermined amounts of an oxygen-containing gas and an alkali are mixed into the slurry in the mixer 15. The pulp slurry is fed from the mixer 15 into a second treatment column 16 through the feed inlet at the bottom thereof, and is discharged through the discharge opening at the top portion of the second treatment column 16. Preferably, at this step, the pressure of the top chamber of the second treatment column 16 is 0 to 7 kg/cm$^2$G. Also preferably, the residence time of the pulp slurry in the second treatment column 16 is 5 to 90 minutes.

The delignified slurry discharged from the second treatment column 16 is fed to a deaerator (not shown) and is deaerated and fed into filtering and washing apparatus (not shown), where the pulp is separated from the treating liquid, washed and recovered.

The delignification treatment system shown in FIG. 3 comprises two treatment columns 14 and 16 connected to each other in series. Note, the number of treatment columns used may be one, or three or more, and a plurality of the treatment columns may be arranged in series.

In FIG. 3, valves 17 and 18 are used for collecting samples from the pulp slurries discharged from the treatment columns 14 and 16, respectively.

The flow conditions of the pulp slurry in the treatment apparatus of the present invention can be evaluated by adding lithium chloride (LiCl), as a tracer, to the pulp slurry to be fed into the treatment apparatus, actually measuring the time from the stage at which the tracer-containing pulp slurry is fed into the treatment apparatus to the stage at which the tracer is detected from the pulp slurry discharged from the discharge opening of the treatment apparatus, and comparing the actually measured time with the theoretical time calculated from the capacity of the apparatus (including the tank, conduits, treatment column and the like) and the flow speed of the pulp slurry. Namely, if the actually measured time agrees with the theoretical time, this means that the pulp slurry in the treatment apparatus has an ideal uniform flow. If the actually measured time is shorter than the theoretical time, this means that channelling has been generated in the treatment apparatus and a part of the pulp slurry fed in the treatment apparatus is flowing more rapidly and is discharged more rapidly.

EXAMPLES

The present invention will be further illustrated in detail by the following examples.

EXAMPLE 1

Figure 4:
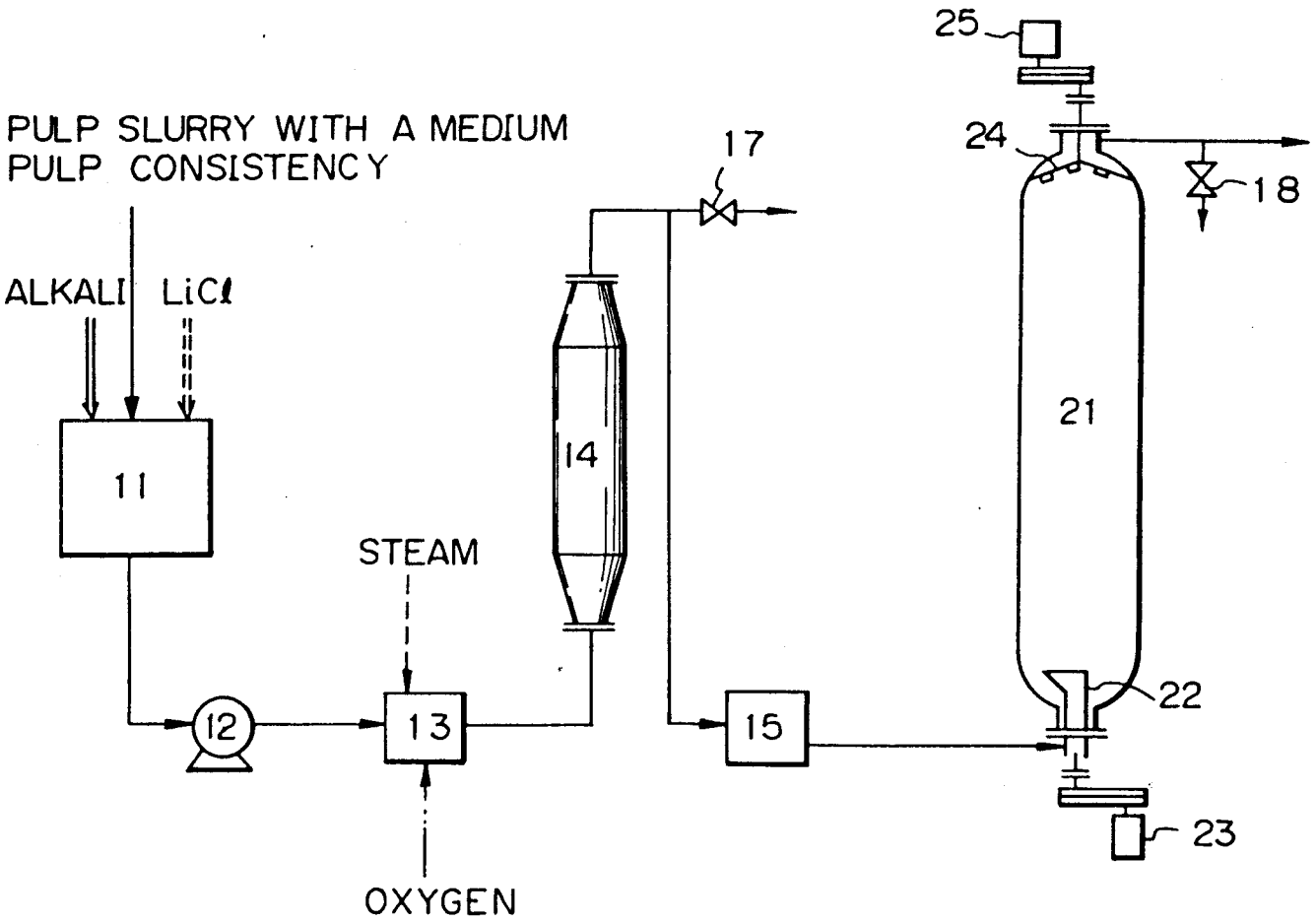
FIG. 4 is a diagram illustrating the treatment apparatus system including the apparatus of the present invention and the comparative treatment apparatus used in Example 1.

The delignification apparatus system FIG. 4 was used. Namely, in the same apparatus system as shown in FIG. 3, the treatment column 16 of the present invention was replaced by a conventional treatment column 21.

In FIG. 4, the barrel portion of the comparative treatment column 21 had an inner diameter of 4 m and a length of 23.5 m; the convergence angle of the bottom portion being about 120 degrees and the convergence angle of the top portion being about 120 degrees. A distributor (6 rpm, 15 kW) 22 was arranged in the bottom portion and driven by a motor 23, and a discharger (2 rpm, 45 kW) 24 was arranged in the top portion and driven by a motor 25.

In FIG. 4, the treatment column 14 of the present invention was not provided with the distributor and discharger, and this treatment column had the following dimensions and convergence angles.

Barrel chamber
inner diameter: 2.25 m,
length: 13.3 m
Bottom chamber—convergence angle $\alpha$: 44 degrees
Top chamber—convergence angle $\beta$: 44 degrees A tracer consisting of LiCl was added to the pulp slurry, and the treatment conditions were as follows.

Kind of pulp: Douglas fir produced in North America
Consistency of cellulose pulp: 10%
Flow rate of cellulose pulp slurry: 3.67 m$^3$/min
Kapper number of untreated pulp: 30
Kapper number of treated pulp: 14
Temperature of treatment column 14 and 21: 110° C.
Pressure at the top of treatment column 14: 7 kg/cm$^2$G
Pressure at the top of comparative treatment column 21: 4 kg/cm$^2$G
Amount of oxygen: 30 kg/ton of absolutely dried pulp
Amount of alkali (NaOH): 25 kg/ton of fully dried pulp In each of the treatment column 14 and the comparative treatment column 21, the actual flow time of the pulp slurry was measured by the detection of LiCl, and was compared with the theoretical flow time.

The results are shown in Table 1.

TABLE 1

| Item | Type of treatment column | Treatment Apparatus 14 (present invention) | Treatment Apparatus 21 (comparison) |
|---|---|---|---|
| Flow speed W (m/min) of cellulose pulp slurry through barrel chamber | | 0.905 | 0.286 |
| Theoretical flow time (A) (min) | | 16 | 77 |
| Actual flow time (B) (min) by LiCl detection method | | 16 | 67 |
| Difference [(A) − (B)] | | 0 | 10 |
| Channeling ratio (%) (= [(A) − (B)]/(A) × 100) | | 0 | 13 |

As apparent from the results shown in Table 1, in the treatment column 14 of the present invention, the actual flow time by the LiCl detection method in the treatment of the pulp cellulose satisfactorily agreed with the theoretical flow time, and the flow of the cellulose pulp slurry in the treatment column 14 was uniform and channelling did not occur. Namely, it was confirmed that a short path was not formed for a portion of the pulp slurry.

In contrast, in the comparative treatment column 21, the actual flow time for the treatment of the pulp slurry was 10 minutes shorter than the theoretical flow time. This means that, in the comparative treatment column 21, although the distributor 22 and discharger 24 were arranged, the flow of the pulp slurry was uneven and channelling was generated, and therefore, a portion of the pulp slurry was discharged earlier than another portion.

EXAMPLE 2

By using the treatment column 14 used in Example 1, the same operations as described in Example 1 were carried out except that the flow speed W of the cellulose pulp slurry through the barrel chamber of the treatment column 14 was changed to 0.750, 0.630, 0.400 or 0.350 m/min. At each flow speed, the actual flow time and the theoretical flow time were determined by the LiCl detection method.

The results are shown in Table 2.

TABLE 2

| | Run 1 (present invention) | Run 2 (present invention) | Run 3 (present invention) | Run 4 (comparison) |
|---|---|---|---|---|
| Flow rate ($m^3$/min) of cellulose pulp slurry | 2.98 | 2.50 | 1.59 | 1.39 |
| Flow speed W (m/min) of cellulose pulp slurry through barrel chamber | 0.750 | 0.630 | 0.400 | 0.350 |
| Actual flow time (B) (min) | 19.0 | 22.5 | 35.0 | 36.0 |
| Theoretical flow time (A) (min) | 19.0 | 23.0 | 36.0 | 41.0 |
| Difference [(A) − (B)] (min) | 0 | 0.5 | 1.0 | 5.0 |
| Channeling ratio (%) [(A) − (B)]/(A) × 100 | 0 | 2.2 | 2.8 | 12.1 |

Figure 5:
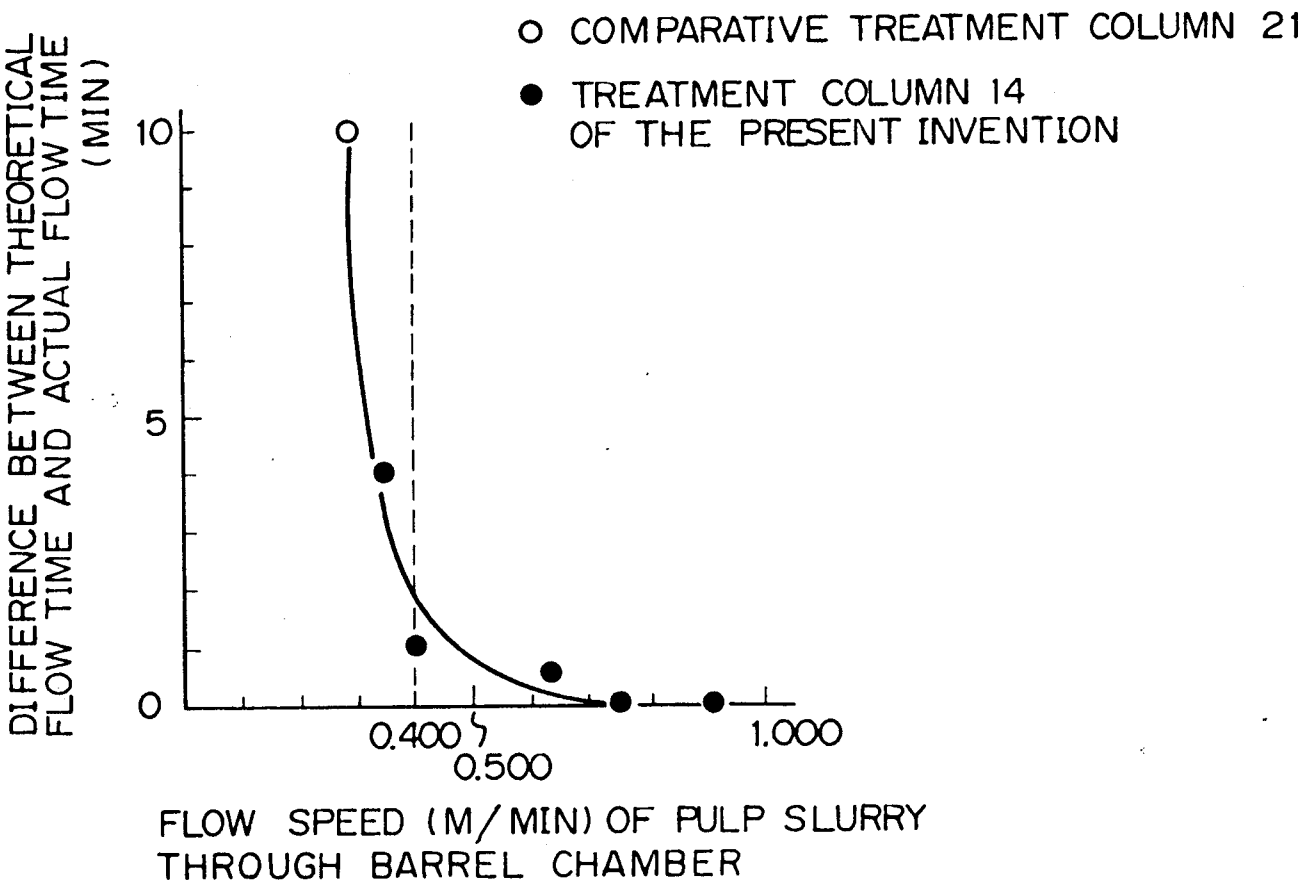
FIG. 5 is a graph illustrating the relationship between the flow speed of the cellulose pulp slurry in the barrel chamber of the treatment apparatus in the delignification of a cellulose pulp and the difference between the theoretical time necessary for the detection of LiCl and the actually measured detection time for LiCl.
Figure 6:
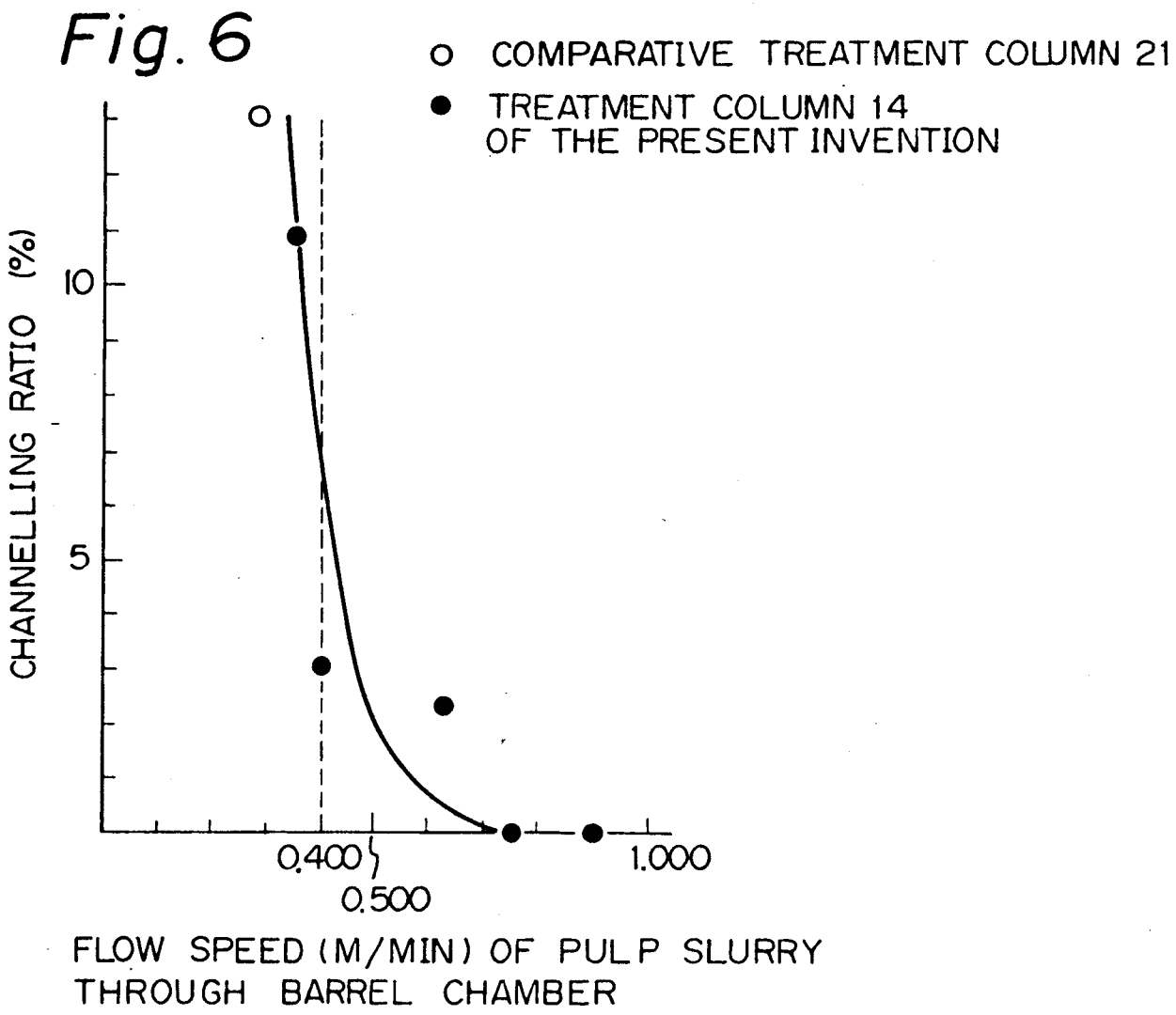
FIG. 6 is a graph illustrating the relationship between the flow speed of the cellulose pulp slurry in the barrel chamber of the treatment apparatus and the channelling ratio.

Based on the data shown in Table 2, the relationship between the flow speed W of the cellulose pulp slurry through the barrel chamber and the difference (Dif) between the theoretical flow time (A) and the actual flow time (B) is shown in FIG. 5, and the relationship between the flow speed W and the channeling ratio is shown in FIG. 6.

From Table 2 and FIGS. 5 and 6 it is understood that, when the treatment apparatus of the present invention is used, by controlling the flow speed of the cellulose pulp slurry through the barrel chamber of the treatment apparatus to a level of 0.4 m/min or more, the flow of the pulp slurry can be uniformalized and a generation of channeling can be prevented or reduced.

EXAMPLES 3, 4 AND 5

In each of Examples 3, 4 and 5, the same operations as in Example 2 were carried out except that the inner diameter of the barrel chamber, the convergence angle $\alpha$ of the bottom chamber and the convergence angle $\beta$ of the top chamber in the treatment column 14, and the flow speed of the cellulose pulp slurry through the barrel chamber were changed to those shown in Table 3.

It was found that channeling was not generated in any of Examples 3, 4 and 5.

TABLE 3

| Example No. | Inner diameter D (m) of barrel chamber | Convergence angle $\alpha$ (degrees) of Bottom chamber | Convergence angle $\beta$ (degrees) of Top chamber | Flow speed (m/min) of cellulose pulp Slurry through barrel chamber | Pulp consisting (%) | Occurrence of channeling |
|---|---|---|---|---|---|---|
| | | Item | | | | |
| 3 | 2.5 | 36 | 36 | 0.64 | 10 | No |
| 4 | 3.0 | 36 | 36 | 0.72 | 10 | No |
| 5 | 3.2 | 36 | 36 | 0.64 | 10 | No |

As clearly shown in Tables 1 to 3, due to the use of the apparatus and process of the present invention, a cellulose pulp slurry flowed uniformly through the apparatus and was evenly delignified without a generation of channeling. Also, it was confirmed that the apparatus and process of the present invention do not need the arrangement and employment of a distributor for mechanically feeding the cellulose pulp slurry and regulating the flow of the slurry, or a discharger for mechanically discharging the slurry.

We claim:

1. An apparatus for the delignification of cellulose pulp, comprising:

a cylindrical barrel chamber extending in a vertical direction;

a substantially cone-shaped bottom chamber connected to the lower end of the barrel chamber, said cone-shaped bottom chamber extending and converging downward to a circular inlet means for feeding a cellulose pulp slurry to be delignified therethrough formed at the lower end of the bottom chamber; means for delignifying the pulp slurry; and a substantially cone-shaped top chamber connected to the top end of the barrel chamber, said cone-shaped top chamber extending and converging upward to a circular outlet means for discharging the delignified cellulose pulp therethrough formed at the top end of the top chamber, said cone-shaped bottom chamber and said cone-shaped top chamber each converging at an angle of convergence of 60 degrees or less through the circumference of the circular inlet and the circumference of the circular outlet, respectively.

2. The apparatus as claimed in claim 1, wherein the circular inlet means of the cone-shaped bottom chamber is not provided with a distributor for mechanically feeding the cellulose pulp slurry to be delignified and regulating the flow of the slurry, and the circular outlet means of the cone-shaped top chamber is not provided with a discharger for mechanically discharging the delignified cellulose pulp slurry.

3. A process for the delignification of cellulose pulp using an apparatus including:

a cylindrical barrel chamber extending in a vertical direction;

a substantially cone-shaped bottom chamber connected to the lower end of the barrel chamber, said cone-shaped bottom chamber extending and converging downward to a circular inlet means for feeding a cellulose pulp slurry to be delignified therethrough formed at the lower end of the bottom chamber; means for delignifying the pulp slurry; and a substantially cone-shaped top chamber connected to the top end of the barrel chamber, said cone-shaped top chamber extending and converging upward to a circular outlet means for discharging the delignified cellulose pulp therethrough formed at the top end of the top chamber, said cone-shaped bottom chamber and said cone-shaped top chamber each converging at an angle of convergence of 60 degrees or less through the circumference of the circular inlet and the circumference of the circular outlet, respectively comprising the steps of:

feeding a cellulose pulp slurry containing an alkali and oxygen and having a pulp consistency of 8 to 15% at a temperature of 70° C. to 140° C. into the cone-shaped bottom chamber through the circular inlet means; delignifying the pulp slurry and discharging the delignified cellulose pulp slurry from the cone-shaped top chamber through the circular outlet means while controlling the flow speed of the cellulose pulp slurry in the cylindrical barrel chamber to a level of 0.4 m/min or more.

4. The process as claimed in claim 3, wherein the feeding step is carried out without mechanically feeding the cellulose pulp slurry or regulating the flow of the slurry, and the discharging step is carried out without mechanically discharging the cellulose pulp slurry.

* * * * *